US007673407B2

(12) United States Patent
Cowdrey et al.

(10) Patent No.: US 7,673,407 B2
(45) Date of Patent: Mar. 9, 2010

(54) DOCUMENT AND ENGINEERING DRAWING HOLDER/PROTECTOR

(76) Inventors: Donald William Cowdrey, P.O. Box 1706, Clear Lake Oaks, CA (US) 95423; Gary Truesdale Gibbs, 2412 Foothill Blvd., SP4, Calistoga, CA (US) 94515

( * ) Notice: Subject to any disclaimer, the term of this patent is extended or adjusted under 35 U.S.C. 154(b) by 52 days.

(21) Appl. No.: 12/136,225

(22) Filed: Jun. 10, 2008

(65) Prior Publication Data

US 2008/0308666 A1 Dec. 18, 2008

Related U.S. Application Data

(60) Provisional application No. 60/936,032, filed on Jun. 18, 2007.

(51) Int. Cl.
*G09F 19/00* (2006.01)

(52) U.S. Cl. ..... 40/406; 40/409

(58) Field of Classification Search ..... 40/518–523, 40/904, 610, 571, 117; 242/401, 160.2, 170, 242/538, 538.1, 538.2, 538.3, 546.1, 395, 242/395.1

See application file for complete search history.

(56) References Cited

U.S. PATENT DOCUMENTS

| | | | | |
|---|---|---|---|---|
| 4,487,244 | A | 12/1984 | Olson | |
| 5,168,647 | A * | 12/1992 | Castro | 40/518 |
| 5,347,735 | A * | 9/1994 | Pratt | 40/518 |
| 5,942,706 | A * | 8/1999 | Leckie | 84/487 |
| 6,581,869 | B2 | 6/2003 | Arrane | |
| 6,845,806 | B2 | 1/2005 | Gottschall et al. | |
| 2007/0195514 | A1 | 8/2007 | Katz et al. | |

OTHER PUBLICATIONS http://www.chestnuthilllocal.com/issues/2007.07.26/locallife2.html, Web pages showing image of a Sephardic Style Torah Case.

* cited by examiner

*Primary Examiner*—Cassandra Davis
(74) *Attorney, Agent, or Firm*—Edward S. Sherman

(57) ABSTRACT

A carrier and protective case are particularly useful for storing and viewing large format documents, which can be spooled together or inserted in a series of spooled transparent sleeves. The web like spools is stored on two spaced apart rollers that are in rotary engagement with opposing halves of the case, and nested within the case or a frame when the opposing halves are folded together.

20 Claims, 9 Drawing Sheets

DOCUMENT AND ENGINEERING DRAWING HOLDER/PROTECTOR

CROSS REFERENCE TO RELATED APPLICATIONS

The present application claims priority to the U.S. provisional patent application having Ser. No. 60/936,032, filed Jun. 18, 2007, which is incorporated herein by reference.

BACKGROUND OF INVENTION

The present invention relates to a method and apparatus for protecting, storing, viewing, and transporting multiple engineering drawings and plans of various sizes.

Field copies of Engineering Drawings are normally "blueprints" copied from the original drawings in various sizes up to 36×44 inches. These sets are rolled into bundles and provided to the various contractors: grading, construction, mechanical, electrical, HVAC, electronic and other servicing vendors. These copies are used in the back of pickup trucks, beds of vans, hoods of vehicles and outdoor tables for viewing reference as the contractor provides the services to the specifications outlined in the drawing. Winds on the job tear or blow the drawings around, rocks or dirt clods used to hold the drawings down, rain, coffee cup, drink cans or bottle rings can alter details of the drawings, requiring the contractor to "best guess" the specifications or obtain another blueprint copy before proceeding with the job. Jobs completed with "best guesses" can result in completion delays and increased costs, as the job has to be redone or corrected. At the end of each work day the plans are normally rerolled into bundles. The rolling and unrolling contribute to the unprotected blueprints deteriorating condition throughout the construction project.

It is therefore a first object of the present invention to provide an improved means to store and transport large format or scrolled documents in a compact space.

It is another object of the present invention to provide an improved means to open such document from the more compact stored state, and to do so rapidly without damaging the documents.

It is a further object of the present invention to provide an improved means to view and use such documents, while still protecting them from damage, and in particular in field conditions, and to then rapidly return them to storage and select another document for view.

SUMMARY OF INVENTION

In the present invention, the first object is achieved by providing a document carrier comprising, a substantially co-planar frame having at least a first and second planar portion in hinged connection along a common side, the hinge having a rotary axis disposed parallel and coupled to the common sides, two roller supports extend upward from the periphery of opposite sides of each of the first and second planar portions of said substantially co-planar frame, each of pair roller supports defining an axial bearing for a roller, the axes of said roller being parallel to the rotary axis of the hinge.

Thus, the document, though initially having its opposing ends wrapped around rollers, when the rollers are fitted into the roller supports, is unrolled to the desired portion is laid flat over the frame for further study or modification. The document may be a continuous scroll, or may be a series of flat pages inserted into a continuous roll formed of plurality of adjacent transparent pockets, each pocket capable of holding at least one document.

A second aspect of the invention is characterized in that the roller supports are disposed non-equidistant from the hinge axis on the first and second planar portion of said frame.

A third aspect of the invention is characterized in that the offset in distance of the roller supports in the first and second planar portion of said frame is at least each twice the vertical distance from the planar portion to the axial bearing of the roller support.

The above and other objects, effects, features, and advantages of the present invention will become more apparent from the following description of the embodiments thereof taken in conjunction with the accompanying drawings.

DETAILED DESCRIPTION

Figure 1:
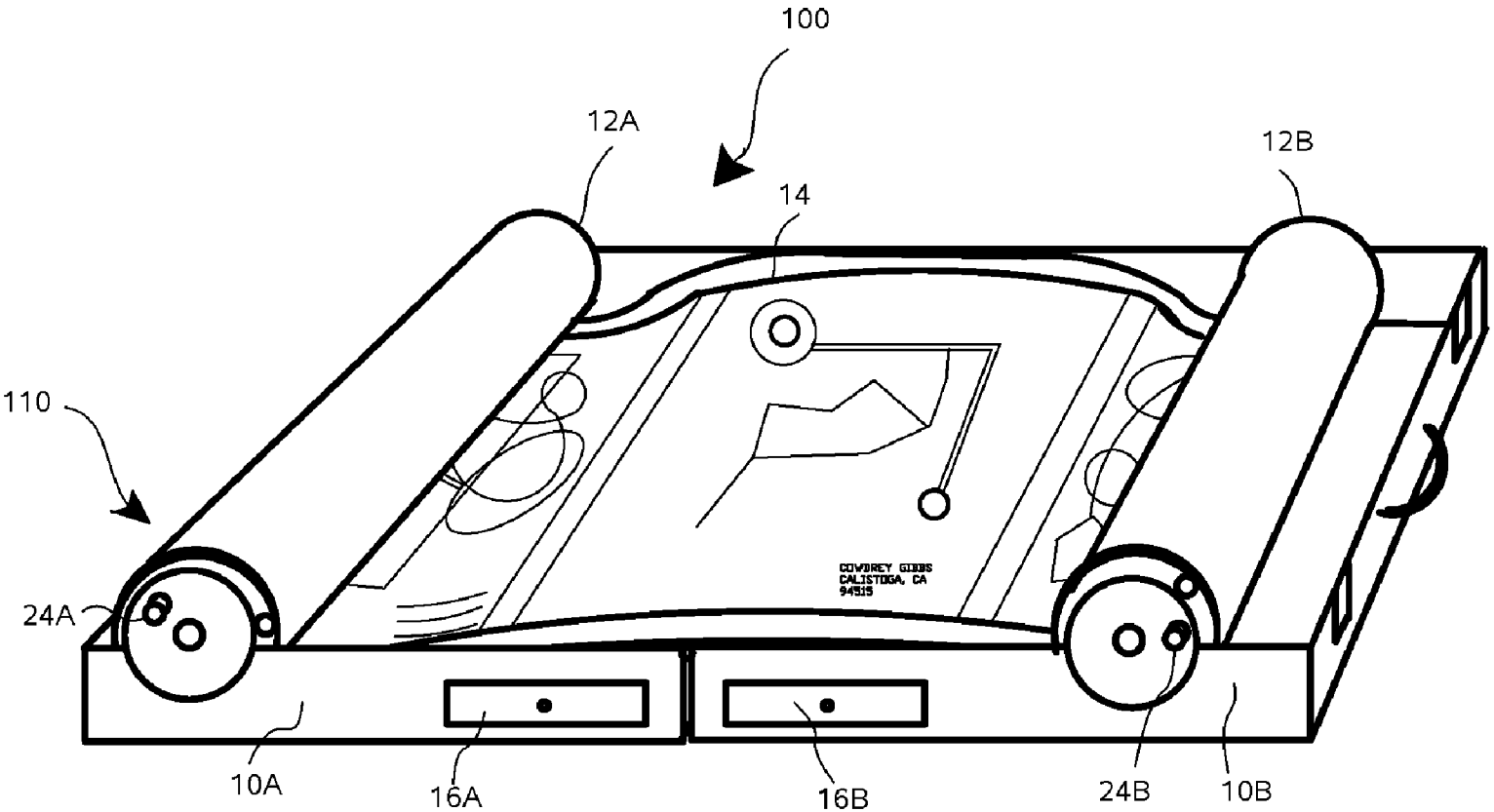
FIG. 1 is a perspective view of a first embodiment of the invention in an open state for viewing and using the documents contained therein.

Referring to FIGS. 1 through 9, wherein like reference numerals refer to like components in the various views, there is illustrated therein a new and improved Carrier and Protector device for holding documents, and in particular Engineering Drawings for storage, transport and viewing, which is generally denominated 100 herein.

Figure 8:
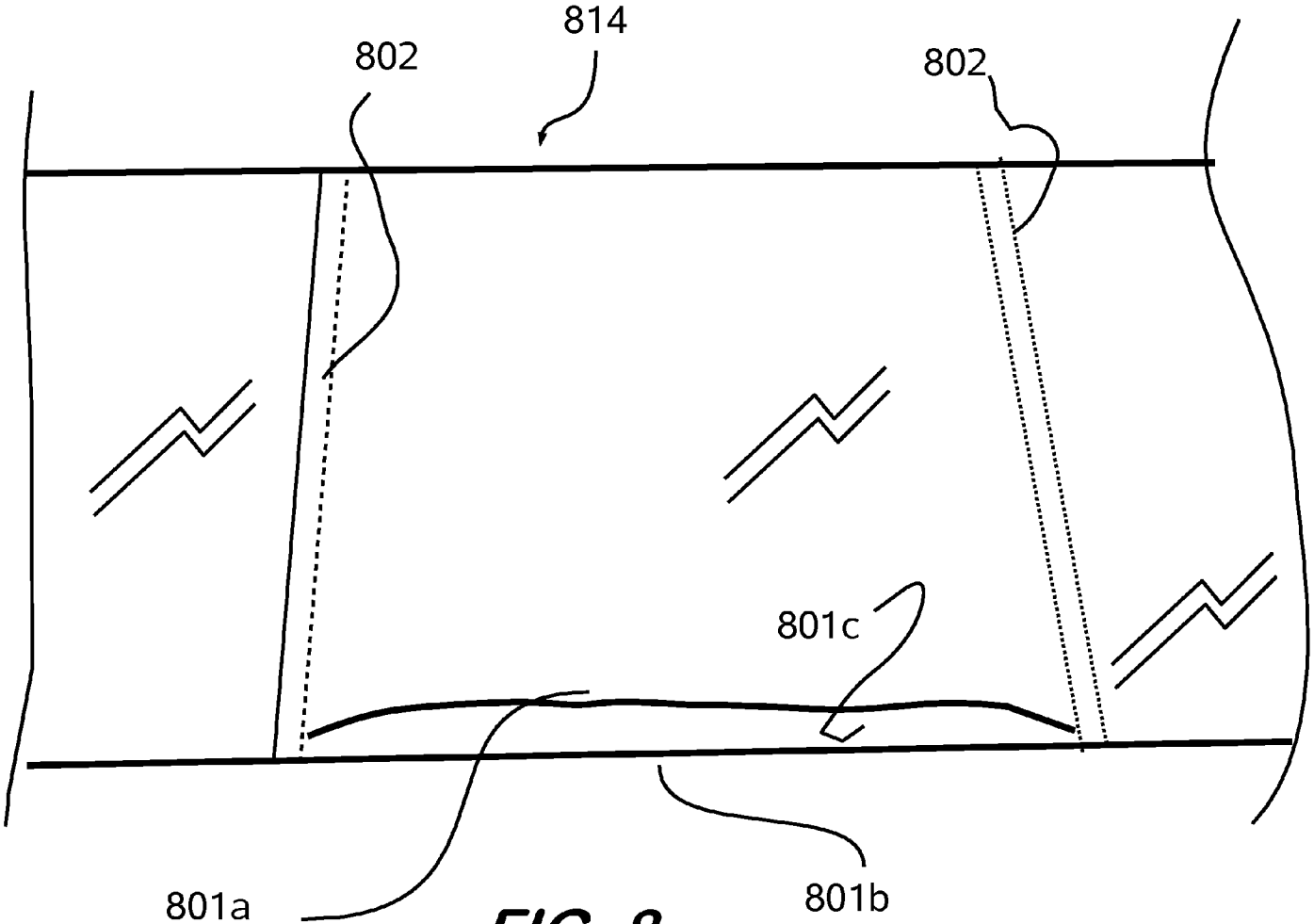
FIG. 8 is perspective view of the document sleeves of FIGS. 1-3 and 7.

In accordance with one embodiment of the invention, generally illustrated in FIG. 1, The devise 100 comprises a $1^{st}$ roller 12A, $2^{nd}$ roller 12B that support a plan holder 14, or a scrolled, that is continuous elongated document with opposing side of the plan holder or document 14 that has opposite sides wrapped at least partially around roller 12A and 12B. Thus, between rollers 12A and 12B is a generally planar open portion for reading and viewing the document or portions thereof. The portion of the plan holder or document not wrapped and hence suspended between rollers 12A and 12B can lie flat and be viewed or otherwise utilized without removing the plan holder 14 or document from the device 100A. One embodiment of a plan holder 14 is shown in FIG. 8.

Figure 2:
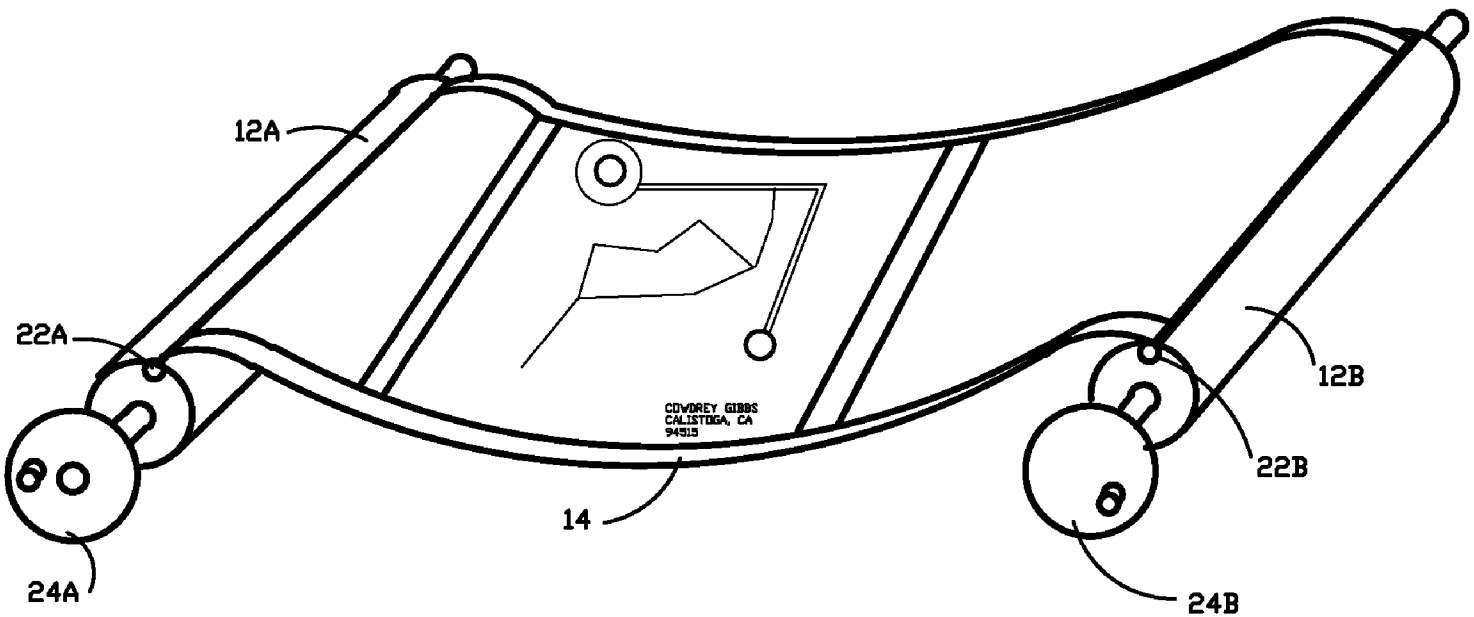
FIG. 2 is an exploded perspective view of the embodiment of FIG. 1
Figure 3:
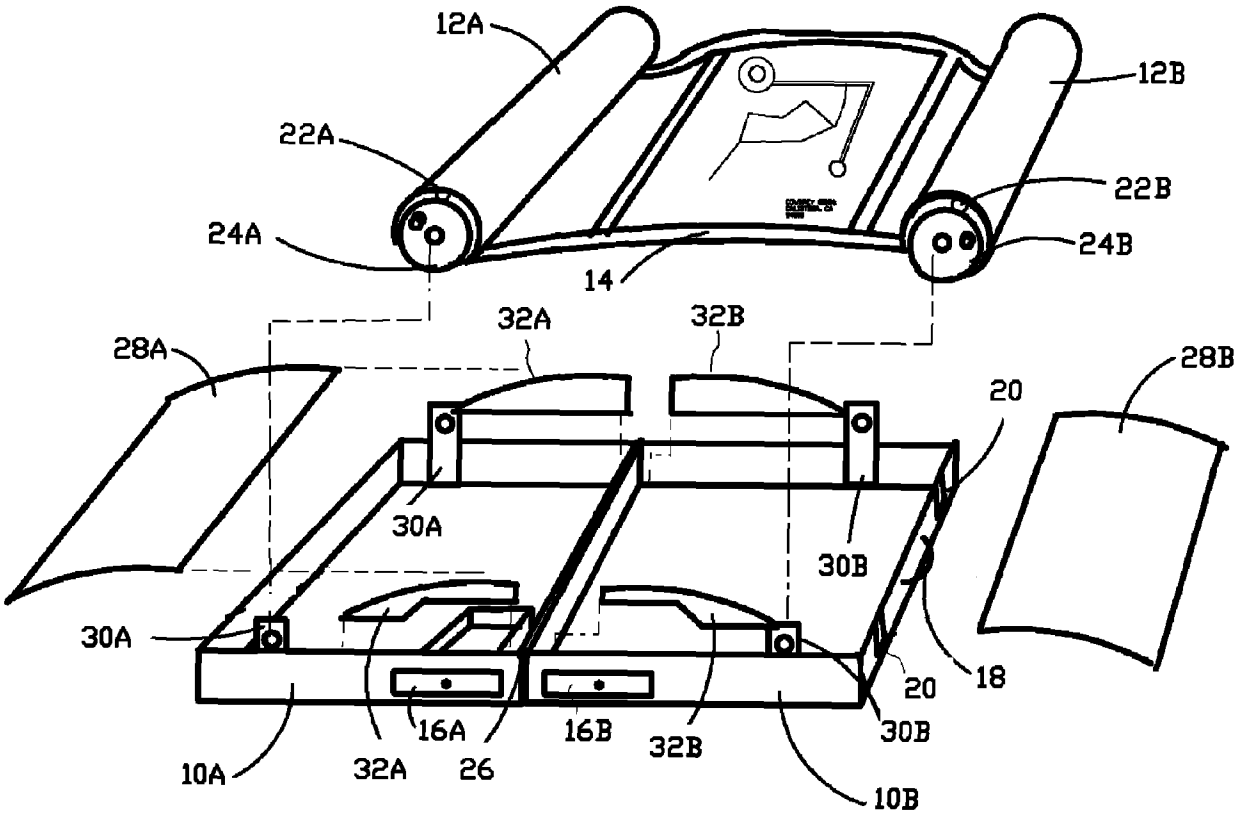
FIG. 3 is another exploded view of the carrier of FIG. 1.

The rollers 12A and 12B fit in spaced apart rotary engagement in receiving slots in a 30A and 30B in the opposite sides of the multiple segment frame 110 that comprise device 100. In the embodiment of FIG. 1-3, the frame 110 comprises mating cavity halves 10A and 10B connected by a hinge 26. As described in other embodiments, the frame 110 may have more than two engaging portions that are generally planar where they meet in the open state and are connected in rotary engagement by a hinge at their common edges.

FIG. 3 shows an exploded view of the carrier 100 when the carrier is open for viewing. This view in particular shows how glide support surface 28A and 28B nest in cavity halves 10A and 10B respectively, being supported by arced supporting rib pairs 32A and 32 that are disposed on the inner side walls of cavity halves 10A and 10B. The glide support surface, though not essential to rotate the rollers, do provide a hard surface to support the document or plan holder 14 for writing and the like.

Different parts of the document are accessed by rotating at least one of plan roller 12A and B using a turning crank 24A and B which are coupled to the cylindrical base thereof. Optionally, the document or retaining sleeve 14 is inserted into a slot in the roller and held down by a retaining dowel 22. The roller turning crank 24 can be either co-axial to the roller cylinder 12 or offset from the roller axis, as well as be disposed on one or both sides of each roller 12A and 12B. When the plan holder or document 14 is to be protected or transported the two halves 10A and 10B are folded together via the connecting rotary hinge 26, after which the device 100 is securely closed by engage mating latches 20A and B latches on halves 10A and 10B respectively.

The device 100 should be constructed of a material rugged enough to hold and protect the container and its contents when carried and used in the field. Any of the components shown in FIG. 1-9 the device or container 100, and interior components, are optionally made of wood. However they can be made from other materials such as forms of flexible material such as canvas, heavy duck and other flexible materials as used in making luggage or forms of plastic, wood, metal or fiberglass. More particularly, in the embodiment of FIG. 4-7, the upright brackets 433 are preferably ABS plastic, as are the frame segments 410*a, b* and *c*, which are welded together with ABS plastic cross braces 434. It should be apparent in these embodiment that as instrument drawers 16A and B are below glide supports surfaces 32A and B, they are also accessible outside the device 100 when it is closed, as the closed frame 110 now forms a box or case with exterior handle 18 on side 10B in FIG. 3.

Preferably, in the embodiment of FIG. 1-3 the hinge 26 is a piano hinge to provide for support along most of the length of the container when open, enabling the rolling of the plan holder 14 such that the underlying glide surface 28A and 28B provide support for writing notes or editing document. Glide surfaces 28A and 28B are preferably made of smooth surfaced wood in order to allow the plan holder or document 14 to move smoothly over the surface when rolling the plans into and out of the viewing area and are preferably attached to the compartment sides. Further, closing latches 20 are preferably made of metal to insure that the container remains closed when transporting. A handle 18, also preferably metal, and is attached to aid in the transport of the device 100. Roller brackets 30 provide the method for containing the rollers 12 that are used to move the plans forward and back for viewing. Preferably, plan rollers 12 are made of PVC components or other light weight plastic tubing, while turning cranks 24 are optionally made of wood, but can be any form or shape of a conventional hand operated crank However other versions of the various components can be made from forms of plastic, cloth straps, metals or other materials or combinations which can accomplish the same functions as described for the above listed components, or equivalents thereto.

Figure 4:
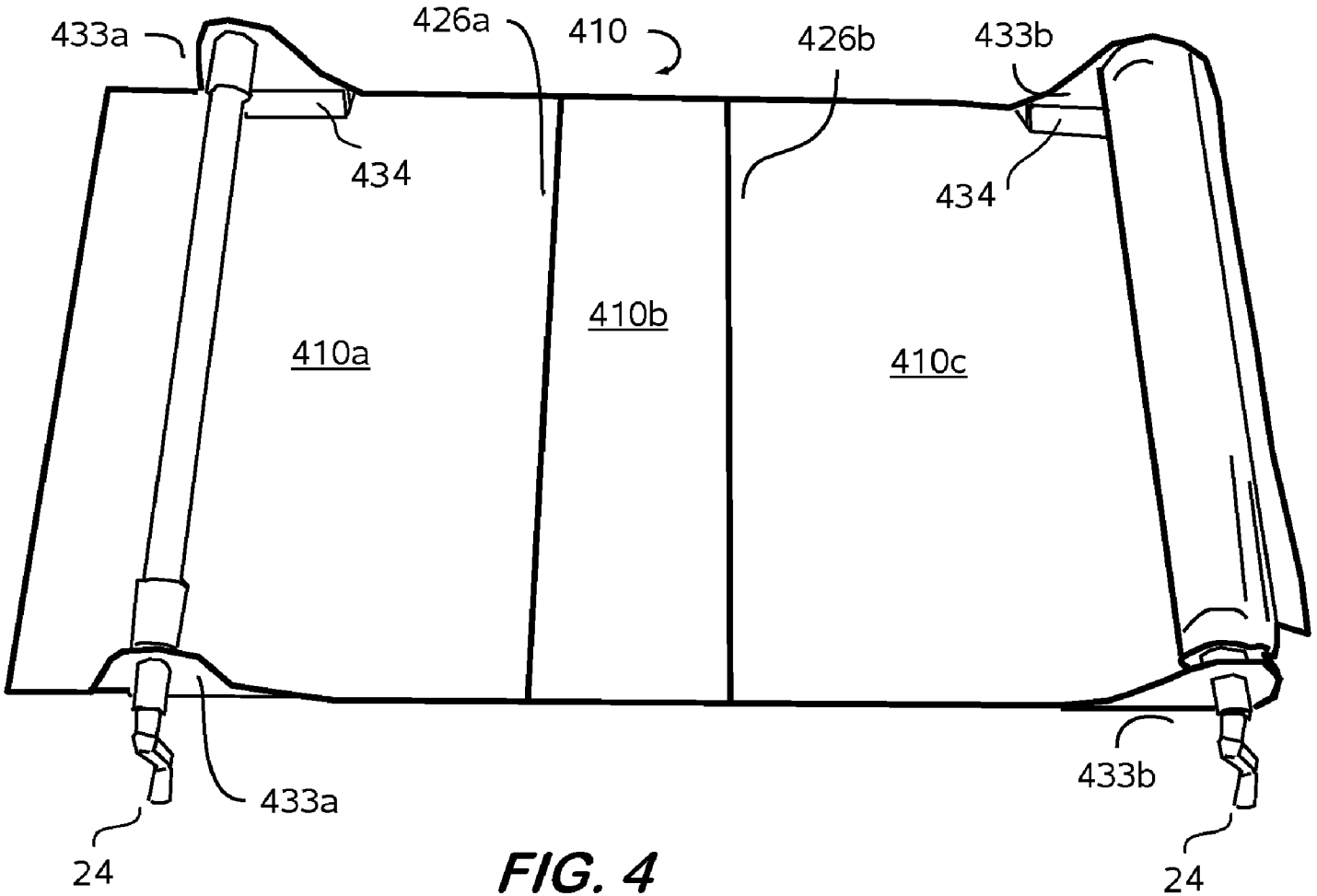
FIG. 4 is a perspective view of a second embodiment of the invention in an open state for inserting documents.
Figure 5:
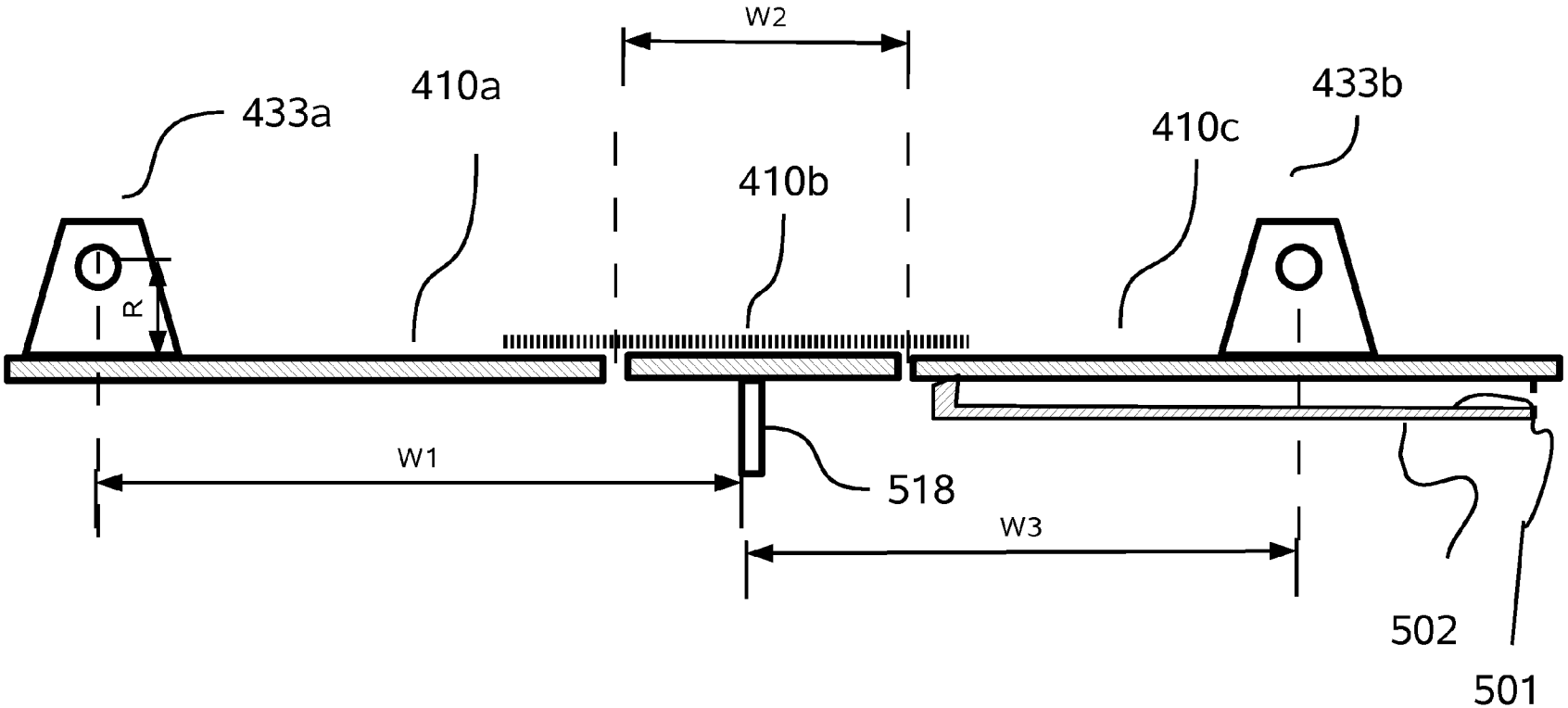
FIG. 5 is a cross-sectional elevation of the embodiment of FIG. 4 in an open state.

In another embodiment, shown in FIG. 4, device 100 is formed of frame 410 that has 3 segments, 410*a*, 410*b* and 410*c*, that form the outside of the device 100. FIG. 5 is intended to illustrate the preferred geometric proportions of the three elements with respect to the radius, R, the nominal radius of the largest combination of the document or document cover 14 and roller 12 that is held in the device 100. The same proportions relate to the preferred spacing of the comparable components in FIG. 1-3 that allow the cavity halves 10A and 10B to close, for transport nesting rollers 12A and 12B side by side.

Figure 6:
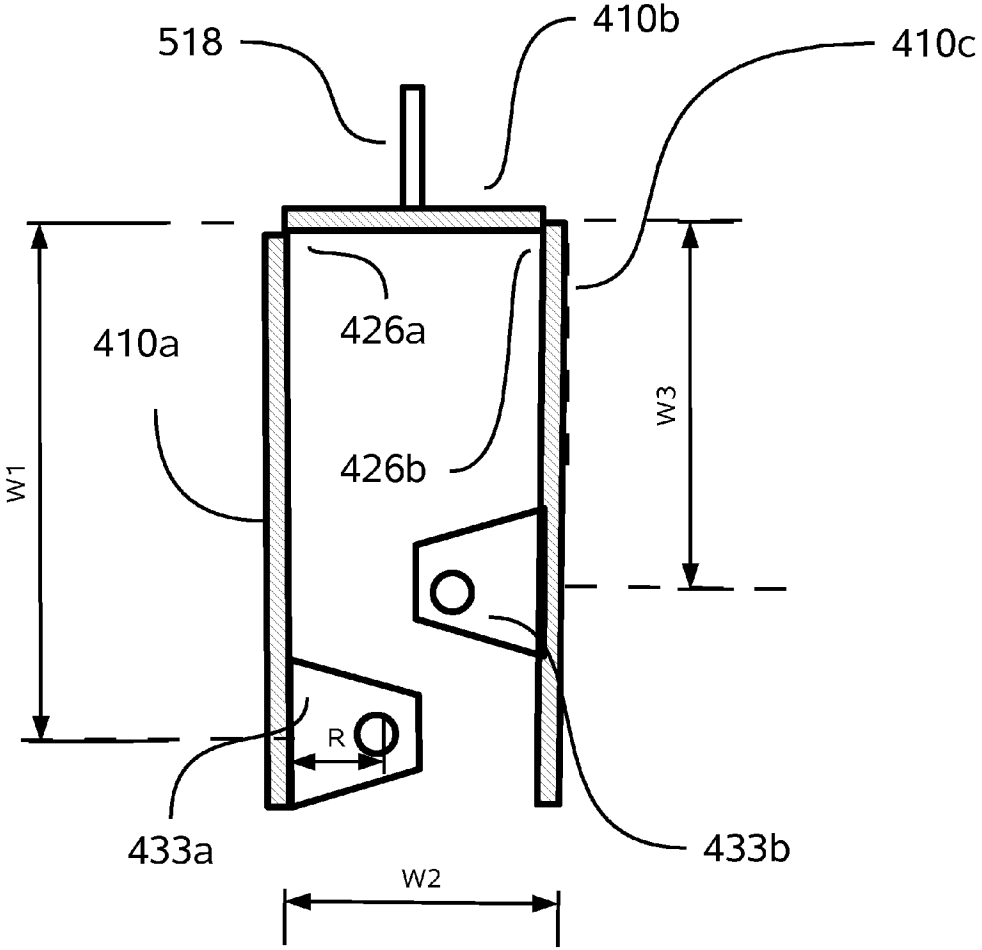
FIG. 6 is a cross-sectional elevation of the embodiment of FIG. 4 in a closed state.

The connecting hinges 426*a* and 426*b* fold enable frame segments 410*a-b* and 410*b-c* to respectively fold as shown in FIG. 6 so that the reverse side of center segment 410*b* will then form the top of the closed device 100 with the handle 518 extending upward. The hinges 426*a* and 426*b* are preferably disposed at the common inner upper edges of adjacent segments 410*a-b* and 410*b-c*. Roller slots 430*a* and 430*b* are formed in upright brackets pairs 433*a* and 433*b* respectively. Thus, the distance from the flat surface of segment 410*a* to the center of roller slots 430*a* is at least R. The distance from the flat surface of segment 410*b* to the center of roller slot 430*b* is also at least R. The center segment 410*b* has a width W2, which is at least 2R.

The center of upright brackets 433*a* on the first segment 410*a* is offset from the middle of second 410*b* (at handle 518) by a distance W1. However, the center of upright brackets 433*b* on the thirds segment 410*c* is offset from the middle of second segment 410*b* by a distance W3.

The side frame segment 410*a* has a width that is generally at least W1 plus R, but preferably slightly larger or at least the greater of W1 and W3 plus R, with sides 410*a* and 410*b* having the same width. As shown in FIG. 6, the hinges 426*a* and 426*b* can fold 90 degrees to enclose rollers 412*a* and 412*b* and document carrier 14 when the difference between W1 and W3 is at least 2R so that the sides 410*a* and 410*b* with brackets 433 can become parallel without attached rollers interfering. In a currently preferred embodiment, W2 is about 7" so that device 100 will hold about 15 pages of 24" by 36" documents.

It should be appreciated that the device 100 of either FIG. 1-3 and FIG. 4-6 can be made and sold as a frame 110 without rollers 12 installed, having upright brackets pairs 433*a* and 433*b* with either roller slots 430*a* and 430*b* or a comparable an axial receiver in lieu of the roller. It will be appreciated by one of ordinary skill in the art that any roller receiving or loading slot 430 or 30, can be a circular hole, or an aperture open on one end with a rounded surface for supporting a roller, or any surface intended to receive bearing element that would rotate a roller holding the document.

In a preferred embodiment of the frame 110 of the device in FIG. 4 to 6, a storage pocket 501 is formed by external flap or sleeve 502.

In summary, as shown in FIG. 4-6 the difference in displacement of first and second roller from center of the frame is preferably at least twice the roller width so that the document carrier can be fully closed.

While the frame segments 410*a, b* and *c* are preferably substantially rigid, it should be appreciated that this is not essential so long as at least portions thereof are sufficiently rigid as to maintain the minimum proportions described above and protected the documents when the segment 410*a* and 410*c* are folded parallel to form the sides.

Figure 7:
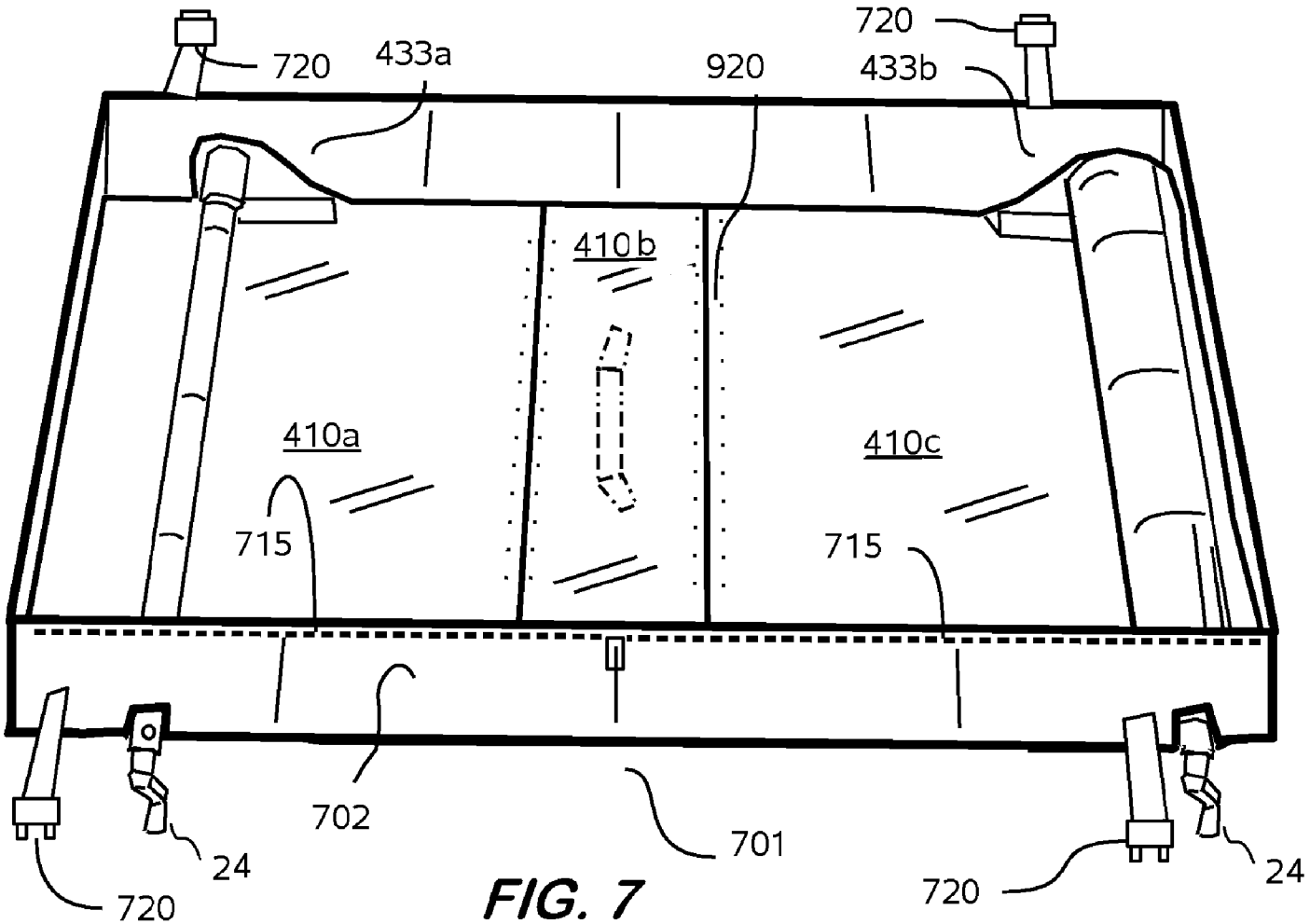
FIG. 7 is a perspective view of a third embodiment of the invention in an open state for inserting documents.

While FIG. 1-3 show a device 110 which preferably has a generally hard rigid frame to form a solid box when closed, the embodiment of FIG. 7 optionally has a flexible cover 701 comprises sides 702 extending upward from the outer periphery of the frame 110 to form a portion of the cover when the hinges 426*a* and 426*b* are folded to nest the roller sides by side and stored within the folded frame 410. Further, latches 720 attached to sides 702 are used to lock the segments 410*a* and 410*c* of the frame 410 when device 100 is used to transport documents or cover 14. Latches 720 are preferably mating snap fasteners, but can be any type of belt loop fasteners or buckle, including hook and loop fasteners. More preferably, opposite side walls 702 of cover 701 continuous are attached by matting peripheral zipper 715.

The document 14 may be a continuous scroll, or may be a series of flat pages joined together via connecting edges, staples or the like, but is preferably handled and viewable as a scroll as shown in FIG. 8. In this embodiment, each page of the plurality of document pages is inserted into retaining sleeves 814 that are transparent on at least one side 801*a*, having a rear supporting side 801*b* and open slot 801*c* between sides 801*a* and 801*b* for receiving the document pages. The document retaining sleeves 814 a linearly joined at seams or edges 802 as shown in FIG. 8. Sleeves 814 are readily formed by hot stamping or ultrasonic welding of plastic sheets, in which the terminal can be taped, glued or inserted into slots for secured attachment to the rollers 12.

Figure 9:
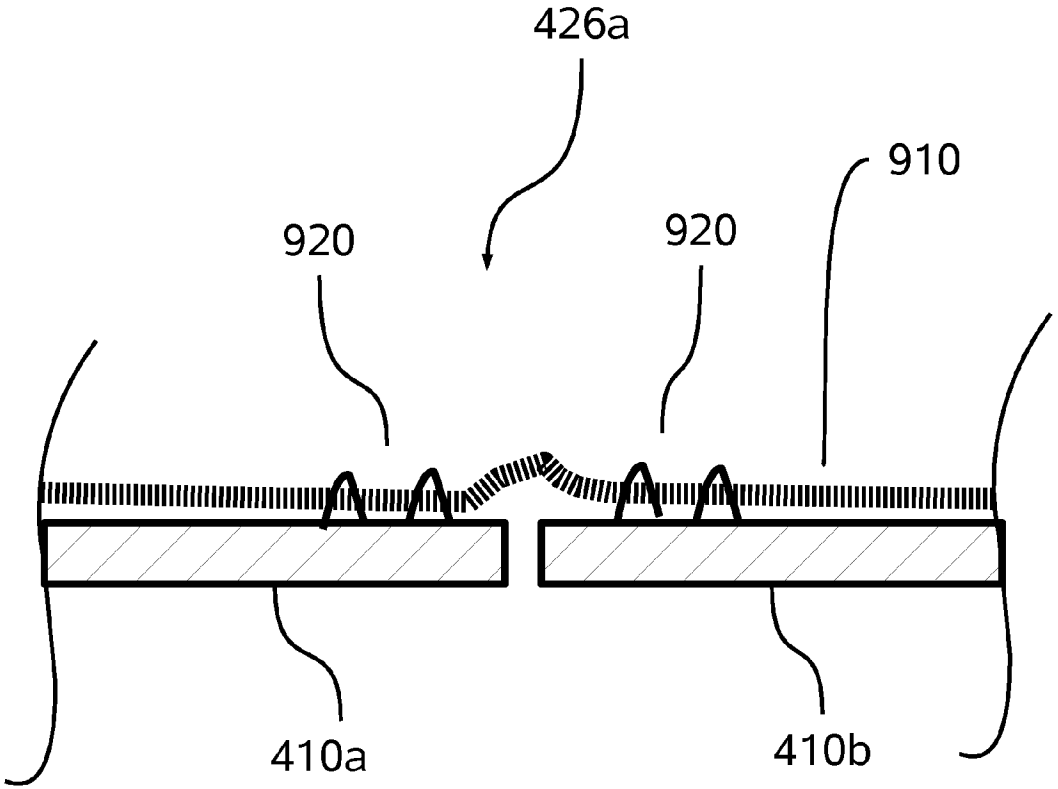
FIG. 9 is an enlarged cross-sectional view of a portion of the frame of the embodiments of FIG. 4 and/or FIG. 7.

FIG. 9 shows the preferred means of forming a hinge 426 between segments 410*a* and 410*b*, and 410*b* and 410*c* in FIG. 4-7. A layer of flexible fabric 910 is stitched in rows 920 in the adjacent segments. As the fabric 910 is flexible it permits the rotation of segments 410*a* and 410*c* with respect to 410*b* without separation. Thus while the embodiment of FIG. 3 the hinge 26 is a piano hinge, while FIG. 4-7 show fabric hinge, either hinge type can be used with either embodiment, including multiple smaller hinges depending on the size and purpose of the device 100. Alternative hinges also include a plurality of opposing hook and loop fastening tapes or strips that can be adjusted to detach and reattach frame segment pieces of different sizes, and thus customer the overall dimensions of the frame to fit carriers of boxes of different sizes.

It will be understood by one of ordinary skill in the art that the shapes of many components shown in FIG. 1-9 can be rectangular, circular or triangular and any other shape or combination thereof.

The device 100 in the most preferred embodiments provide an encased area for carrying and storage of Engineering drawings and or any other documents, and a method of moving drawings into and out of a viewing area for use at the work location either manually or motorized. The flexible drawing carrier 100 shall provide pockets of a transparent covering which will hold all sizes of engineering drawings in place, so that they can be rolled or slid across the viewing area. This transparent covering is preferably made from a material which offers Ultraviolet light filtering to protect the drawings from fading due to prolonged exposure to sunlight.

Generally speaking for devices that are reasonable in size to use and transport, plans up to 36×44 inches, provided for use on the job are selected by the sequence in which they will be used. These drawings are then inserted into the flexible plastic pockets on the flexible plan holder, retaining dowels are inserted into each end of the holder and the ends are slipped into the roller slots. The turning crank is used to position the first drawing into the viewing area and when the next drawing is required, it is rolled into the viewing area with the initial drawing being rolled onto the other roller at the same time. The direction of the drawings can be reversed by use of the opposite turning crank. Should the contractor want to view several plans at once, the plan holder can be pulled off of each roller, without removing it from the rollers and display several plans at once, and when they are no longer required they are rolled up onto the plan rollers. The clear plastic covering of the plan holder protects the drawing from wind and dirt or moisture from rain, cups, cans, bottles and other substances which would alter or obscure the drawing details. At the end of the work day the drawings remain in the plan holder and the container is simply closed by folding it in half and closing the latches. The drawings are always protected when transporting and when in storage, until the next required use.

The use of various embodiments of device 100 as an Engineering Drawing (Blueprint) Holder/Protector Viewer makes the use of drawings and plans on the job sites much easier and protects precise specifications illustrated and stipulated on the plan. Use of the device 100 as described in the various embodiments will reduce or eliminate the need for obtaining replacement blueprints should they become destroyed by wind, rain, dirt, moisture rings from coffee cups, drink cans, bottles and other marks normally made on the blueprint in the course of everyday field use. The services provided using engineering drawings will be less error prone due to smudged or altered drawings and will result in the following:

Due to the drawing being encased in a holder the chance of alteration of specifications by torn or obscured details is eliminated.

By containing all of the drawings within the portable Engineering Drawing container, project delays due to lost or misplaced drawings will be eliminated.

Errors and additional delays and costs associated with torn blueprints and or obscured details, will be eliminated by the protection offered by the use of the Engineering Plan Holder/Protector Viewer.

By reducing confusion in reading Engineering Plans, the job can be completed sooner thus reducing personnel exposure to injury on the job or in transit to and from the job.

Drawers or pockets are provided to enable the storage of frequently used writing and drawing tools and instruments, as well as reading pointers.

Although the description above contains many specifics, these should not be construed as limiting the scope of the invention but as merely providing illustrations of some of the presently preferred embodiments of this invention. For example, the parts can have other geometrical shapes: the carrier can be of a different size or style; there can be fewer or more drawing pockets, it may be assembled differently and the components can be constructed of different materials, but all of the changes will result in an Engineering Drawing Holder/Protector Viewer providing the same function as this invention for use with drawings and blueprints stored and used by contractors and their employees for use in completing the construction project.

Although it was common in ancient times for documents to be recorded on long scrolls of paper or parchments, there existed limited means for rapidly accessing and viewing selected portions of these documents. Recently there have been innovations regarding the display of religious document in scroll form, and in particular Torah scrolls, as disclosed in U.S. Pat. No. 6,581,869 B2 (Arrane, issued Jun. 24, 2003). Further, pending U.S. Patent Application US 2007/0195514 A1 (Katz et al, Pub. Date: Aug. 23, 2007) illustrates a means of overlaying or projecting printed matter over an unrolled Torah scroll. However, these devices require that the scrolls be removed from a protective case before being unrolled.

While round protective cases for Torah scrolls have been in continuous use for centuries, the Torah is first removed and then un-scrolled on a separate table for reading. Such round Torah cases are intended to hold two rollers that support opposite rolled up ends of the scroll in close proximity. While it may be possible in at least some of these traditional Torah cases to rotate both rollers while the Torah scroll is in the case, the Torah still needs to be removed for reading and study.

Accordingly, it should be appreciated that the present invention in other embodiments may be used to hold a Torah, or any other documents that is in a long scroll format, such as the Megillah, or Story of Ester, generally without the use of the sleeves of FIG. 8. Thus, such document can be read when the case is open without removing the document from the case, even if such reading is simply to find or mark the proper place for a public reading before removing the document from the case.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

The invention claimed is:

1. A document case comprising, a) a substantially planar frame having at least a first and second planar portion, each planar portion including a common sides surface that is adjacent one another and an opposite side surface opposite the common side surface, b) at least one hinge providing a hinged connection along the common side surface, the hinge having a rotary axis disposed parallel and coupled to the common sides surface, wherein the planar portions fold towards each other, wherein the common side surfaces form the interior of the case and the opposite sides surfaces thereof form the exterior of the case, c) two pairs of roller supports extending upward from the periphery of common side surface of each of the first and second planar portions of said substantially planar frame by a vertical distance, each of said pair of roller supports defining an axial support for a roller, the axes thereof being parallel to the rotary axis of the hinge, d) wherein a first of the two pairs of the roller supports are disposed on the first planar portion a first distance and a second of the two pairs of the roller supports are disposed on the second planar portion a second distance, wherein the first and second distances are non-equidistant from the rotary axis and are offset from one another by an offset distance.

2. The document case of claim 1 wherein said frame further comprises a third planar portions hinged between the first and second planar portions to provide a geometric center of the frame, wherein the first and second pair of roller supports are disposed on the first and second planar portion being offset non-equidistant from a geometric center of the third planar portion of said frame.

3. The document case of claim 2 wherein the offset distance is at least twice the vertical distance from the planar portion to the axial support for a roller.

4. The document case of claim 2 further comprising a pair of rollers disposed in rotary engagement in said roller supports.

5. The document case of claim 4 further comprising an elongated document carrier having a plurality of linearly joined document retaining sleeves that are transparent on at least one side, the document carrier being connected at opposite ends to each roller of said pair of rollers.

6. The document case of claim 4 further comprising flexible side walls extending upward from the common sides surfaces of each of at least the first and second planar portions of said frame to form a covering portion of the case when the hinges are folded to nest the rollers side by side and stored within the closed case.

7. The document case of claim 6 further comprising at least one zipper to connect the flexible side walls extending upward from at least the first and last planar portions of said frame.

8. The document case of claim 6 further comprising at least one handle disposed on the third planar portion between the first and second planar portion on the opposite surface.

9. The document case of claim 8 further comprising at least one zipper to connect the flexible side walls extending upward from at least the first and last planar portions of said frame.

10. The document case of claim 8 further comprising a plurality of latches to connect the flexible side walls when the case is closed.

11. The document case of claim 4 wherein each roller comprises at least one turning crank disposed on the end thereof outside of said roller supports.

12. The document case of claim 11 wherein at least one roller crank is offset from the roller axis.

13. The document case of claim 4 wherein at least one roller has a longitudinal loading slot.

14. The document case of claim 13 wherein at least one roller further comprising a retaining dowel to holding a document or document carrier member in the longitudinal loading slot.

15. The document case of claim 1 further comprising a pair of rollers disposed in rotary engagement in said roller supports.

16. The document case of claim 15 further comprising an elongated document carrier having a plurality of linearly joined document retaining sleeves that are transparent on at least one side, the document carrier being connected at opposite ends to each roller of said pair of rollers.

17. The document case of claim 15 further comprising substantially solid side walls extending upward from the periphery of the common side surfaces of the frame to form a rigid box when the hinge is folded to nest the rollers side by side and stored to form a closed document case having an exterior.

18. The document case of claim 17 further comprising;

a) an elongated document having each of the opposite sides scrolled onto the rollers with an unscrolled portion extending there between, b) an arcing glide surface that extends upward above each planar portion of the frame from said substantially solid side walls to join above the hinge for supporting the un-scrolled portion of a document between the rollers thereon.

19. The document case of claim 18 further comprising one of more drawers under the arcing glide surface that open from said solid side walls on the exterior of the document case.

20. The document case of claim 1 wherein the offset distance is at least twice the vertical distance from the planar portion to the axial support for a roller.

* * * * *